US007585039B2

(12) United States Patent
Ochiai et al.

(10) Patent No.: US 7,585,039 B2
(45) Date of Patent: Sep. 8, 2009

(54) INK JET PRINTING APPARATUS AND INK JET PRINTING METHOD

(75) Inventors: Takashi Ochiai, Machida (JP); Hitoshi Tsuboi, Kawasaki (JP); Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/953,353

(22) Filed: Dec. 10, 2007

(65) Prior Publication Data

US 2008/0143767 A1 Jun. 19, 2008

(30) Foreign Application Priority Data

Dec. 13, 2006 (JP) ..... 2006-336031

(51) Int. Cl.
*B41J 2/15* (2006.01)

(52) U.S. Cl. ..... 347/12; 347/40; 347/43

(58) Field of Classification Search ..... 347/12, 347/13, 42, 40, 43, 15
See application file for complete search history.

(56) References Cited

U.S. PATENT DOCUMENTS

| | | | | |
|---|---|---|---|---|
| 5,132,702 | A * | 7/1992 | Shiozaki et al. | 347/12 |
| 5,384,587 | A * | 1/1995 | Takagi et al. | 347/41 |
| 6,874,864 | B1 | 4/2005 | Maeda et al. | |
| 7,237,871 | B2 | 7/2007 | Yamaguchi et al. | 347/42 |
| 7,278,700 | B2 | 10/2007 | Yamaguchi et al. | 347/13 |
| 2006/0119632 | A1 | 6/2006 | Ochiai et al. | 347/15 |
| 2006/0119660 | A1 | 6/2006 | Ochiai et al. | 347/40 |
| 2006/0214957 | A1 | 9/2006 | Wada | 347/5 |

* cited by examiner

*Primary Examiner*—Lamson D Nguyen
(74) *Attorney, Agent, or Firm*—Fitzpatrick, Cella, Harper & Scinto

(57) ABSTRACT

An ink jet printing apparatus and an ink jet printing method are provided which use a printing head having a plurality of ejection opening arrays and enable high quality printing without causing uneven density in a conveying direction. For this purpose, by providing a plurality of ejection opening arrays to chips constituting the printing head and changing data assigning ratio of each ejection opening array, deviation in impact positions depending on the distance between the ejection opening arrays becomes inconspicuous.

8 Claims, 15 Drawing Sheets

| | | | | | | | |
|---|---|---|---|---|---|---|---|
| A | C | C | C | A | C | C | C |
| B | B | B | D | B | B | B | D |
| C | C | A | C | C | C | A | C |
| B | D | B | B | B | D | B | B |
| A | C | C | C | A | C | C | C |
| B | B | B | D | B | B | B | D |
| C | C | A | C | C | C | A | C |
| B | D | B | B | B | D | B | B |

DISCHARGE PORT ARRAY

ARRAY A ARRAY B ARRAY C ARRAY D

EXAMPLE OF DISCHARGE PORTS USED FOR RECORDING

| | | | | | | | |
|---|---|---|---|---|---|---|---|
| A | C | A | C | A | C | A | C |
| B | D | B | D | B | D | B | D |
| A | C | A | C | A | C | A | C |
| B | D | B | D | B | D | B | D |
| A | C | A | C | A | C | A | C |
| B | D | B | D | B | D | B | D |
| A | C | A | C | A | C | A | C |
| B | D | B | D | B | D | B | D |

MAIN SCANNING DIRECTION

INK JET PRINTING APPARATUS AND INK JET PRINTING METHOD

BACKGROUND OF THE INVENTION

1. Field of the Invention

The present invention relates to an ink jet printing apparatus and an ink jet printing method which perform printing by ejecting ink from a plurality of ejection openings to a printing medium. In detail, the present invention relates to an ink jet printing apparatus and an ink jet printing method which perform printing using a printing head equipped with a plurality of ejection opening arrays ejecting the same color ink.

2. Description of the Related Art

A printer or a copy machine and the like, or a printing apparatus used as an output device for composite electronics or a work station including a computer or a word processor is configured so that printing can be performed on a printing medium such as a paper or a plastic thin sheet based on printing information. The printing apparatus like this is classified into an ink jet type, a wire dot type, a thermal type, a laser beam type, or the like. The printing apparatus of the ink jet type (ink jet printing apparatus) among printing apparatuses of such various printing types uses an ink jet printing head as a printing unit to perform printing by ejecting an ink toward the printing medium from a ejection opening provided in the printing head. The printing apparatus of such ink jet type has advantages that the printing head is easily downsized, that high resolution image can be formed rapidly, and that noise is small because of non-impact type.

The ink jet printing apparatus like this is roughly classified into two types of a serial type and a full line type depending on its printing method. The ink jet printing apparatus of the serial type uses a method to perform printing while scanning in a main scanning direction intersecting with a conveying direction of the printing medium (sub scanning direction). In this method, every time a printing movement in one time main scanning is finished, a movement in which the printing medium is conveyed by a predetermined amount is repeated, and thus the printing on all region of the printing medium is performed. On the other hand, the ink jet printing apparatus of the full line type uses a printing method to perform only a movement of the printing medium in the conveying direction upon printing. In the full line type, the printing on all region of the printing medium is performed by performing printing continuously for one line while conveying the printing medium by use of the printing head in which ejection openings are arranged across entire width of the printing medium. The ink jet printing apparatus of the latter full line type uses a printing method having a capability of printing with higher speed in comparison with the serial type. For example, the printing with a resolution of 600×600 dpi (dot/inch) for the printing of mono-color such as a sentence, or a high resolution printing with a resolution of 1200×1200 dpi or more for the printing of full-color picture like a photo can be also performed at a high speed of 60 pages or more per minute on the printing medium sized A4.

In the ink jet printing apparatus of the full line type, each ejection opening arranged across all width of printing region prints dots arranged along the conveying direction (hereinafter, the inverse direction of this direction is referred to as a main scanning direction). Accordingly, as with so called a multi-path printing which performs one line printing with a plurality of scanning in the serial type, one line is printed with a plurality of ejection openings, therefore, a variation of ejecting characteristic between the ejection openings cannot be reduced. Because of this, when the ejecting characteristic has a variation such that ejecting is not performed normally, and that an impact location displaces, this type has a defect that a fault in the picture such as stripe, stripe unevenness is easy of appearance. Originally, it is to be desired that all ejection openings shall be manufactured with no defect and an excellent accuracy, however, the number of the ejection openings is great, therefore, it is very hard to manufacture them with no defect and the excellent accuracy. For example, for performing the printing with the resolution of 1200 dpi in a sheet sized A3, it is necessary to provide about fourteen thousand units of the ejection openings (printing width 297 mm) in the printing head of the full line type, therefore, if they can be manufactured, manufacturing cost tends to increase because non-defective ratio is low. Because of this, in the printing head of the full line type, a constitution of so called connection heads so as to realize a long head by arranging relatively low cost short heads used for the printing of the serial type in such a manner that a plurality of units is connected in an arrangement direction of the ejection openings is general.

As one constitution reducing a problem of the above-mentioned variation caused by the printing head of the full line type, in order to weaken an influence applied to the printing with one ejection opening, a constitution in which dots in the main scanning direction shall be printed by not one ejection opening but a plurality of ejection openings is employed. This multi-array constitution of the ejection opening arrays can realize the printing with high-quality picture by reducing the variation of the ejecting characteristic between the ejection openings as well as a multi-path printing in the printing of the serial type. For example, a picture quality of the same level as 4-path printing in the printing of the serial type can be realized in such a way that the ejection opening array is constituted to be multiple as with a constitution in which 4-array ejection openings per one color are provided.

However, the present inventors examined and revealed that, when the printing is performed using the printing head of the multi-array constitution like this, uneven density varied with respect to the main scanning direction, so called conveyance unevenness tends to occur. Specifically, when the plural ejection opening arrays arranged in the main scanning direction are arranged mutually with a certain distance, it is found that the conveyance unevenness occurs remarkably as the distance between those ejection opening arrays becomes great. This is caused by a phenomenon in which the printing medium may be conveyed meanderingly, at that time, there exists a difference of ejection timing between the ejection opening arrays, and as a result the impact location displaces, resulting in the uneven density.

FIG. 13 is a drawing illustrating a situation performing the printing on a printing medium 5 conveyed in the arrow direction in the drawing with a printing head of 4-array constitution (array A, array B, array C, and array D) for the same ink color. Further, FIG. 14 is a graph showing a printing displacement (hereinafter, also referred to as X displacement) caused in such a manner that the printing medium is conveyed meanderingly in a state like a sine curve when the printing is performed with the printing head shown in FIG. 13.

As apparent from FIG. 13, each of four ejection opening arrays is arranged mutually in parallel with a fixed interval in the main scanning direction. In addition, an arrangement direction of ejection opening arrays is equivalent to the conveying direction of the printing medium (main scanning direction). Accordingly, when the printing is performed with ejection openings of four ejection opening arrays, printing timing is different for each array. Incidentally, actually, a dot of the same color is not printed overlapped so often at the same location of the printing medium. Normally, the dots are printed in order with four ejection openings so that they may be adjacent in the main scanning direction with a pitch depending on the resolution. However, since a mutual spacing between these four ejection opening arrays is far greater than the pitch of the above-mentioned adjacent dots, hereinafter, a location at which the dots are printed adjacently in the main scanning direction with these plural ejection openings is described as the same location for simplified description. When the printing is performed at the same location like this, if ejection timing is different for each ejection opening array, a printing displacement of each ejection opening array caused by the difference leads to a condition that phase is shifted as shown in FIG. 14.

A relation between a graph in FIG. 14 and a result of the printing will be described. In any graph of the arrays, there is occurred X-displacement within a range from +15 μm to −15 μm so as to draw a sine (sine wave) curve, and the phase is shifted by the amount corresponding to the difference in ejection timing. Regarding printing result, the printing result at the case in which a straight line is drawn without displacement in X is most preferable, and the uneven density does not occur either.

By the way, a portion in which a difference of X displacement among ejection opening arrays in each graph shown in FIG. 14 is small is each of inflection points of Q1, Q2, Q3, and Q4, and the printing results equivalent to portions near these inflection points Q1, Q2, Q3, and Q4 give almost favorable printing results. Further, in portions except the inflection points, namely, notwithstanding from plus to minus or from minus to plus, P1, P2, P3, and P4 which are large in X displacement variation amount, the printing becomes rough as a result that the impact location of the ink ejected is displaced. Accordingly, the printing result becomes a result with prominent uneven density in which dense portion and rough portion are generated alternately.

FIG. 15 shows that a difference of the X displacement between the array A and the array D and a difference of the X displacement between the array A and the array B in each main scanning position in FIG. 14 are represented in a graph. The comparison of FIG. 14 and FIG. 15 shows that the difference of the X displacement becomes small at a portion equivalent to the inflection points Q1, Q2, Q3, and Q4 in FIG. 14 in FIG. 15. The comparison also shows that the difference between the array A and the array B which are short in distance between the ejection opening arrays is smaller than the difference between the array A and the array D which are long in distance between the ejection opening arrays. Namely, the shorter the distance between the ejection opening arrays becomes, the less the uneven density becomes. Inversely, since the longer the distance between the ejection opening arrays becomes, the greater the X displacement becomes, the uneven density is generated remarkably accordingly. In particular, in a photographic output in which high image quality is required, the uneven density like this becomes unacceptable level.

As mentioned above, the shorter the distance between the ejection opening arrays becomes, the less the uneven density becomes. Namely, the uneven density generated in the printing result can be normally eliminated by performing the printing with one ejection opening array. However, in this case, an effect of so called multi-array constitution, in which when a certain ejection opening has a failure of miss ejecting, other ejection opening performs supplemental ejecting, can not be obtained, therefore, the printing result with high quality printing can not be obtained.

Incidentally, a meandering in the printing medium conveyance causing the above-mentioned problem, needless to say, needs not be a complete sine wave curve as mentioned above. Further, even when the meandering is generated in a part of the conveyance, it is evident that the above-mentioned problem is caused in that part.

Furthermore, this uneven density can be thought to be naturally eliminated by suppressing a conveyance deviation of the printing medium as much as possible. However, the deviation generated on the apparatus like this is hard to be eliminated completely, therefore, the displacement of several 10 μm or so tends to be generated while conveying the printing medium. On the other hand, as the distance between the plural ejection opening arrays is made to be shortened relatively, the uneven density become not conspicuous because a location displacement influence of the impacting is reduced. However, the distance between the ejection opening arrays is hard to be shortened from a consideration of arrangement of the ejection opening, a wiring layout of the printing element provided in the ejection opening, securement of a space portion in which the ink jet printing head and a cap protecting the ink jet printing head may contact each other, and the like.

SUMMARY OF THE INVENTION

The present invention provides an ink jet printing apparatus and an ink jet printing method which enable a high quality printing while suppressing uneven density in a conveying direction using a printing head having a plurality of ejection opening arrays.

In a first aspect of the present invention, an ink jet printing apparatus for performing printing on a printing medium by using a printing head having a plurality of ejection opening arrays each having a plurality of ejection openings for ejecting the same color ink arranged, the ejection opening arrays being arranged along a direction intersecting with an arrangement direction of the ejection openings, is provided. The plurality of ejection opening arrays includes ejection opening arrays positioned at both ends in a direction intersecting with an arrangement direction of the ejection openings, and a ejection opening array other than the ejection opening arrays positioned at the both ends, and ratio of ejecting data distributed to each of the ejection opening arrays positioned at the both ends is smaller than ratio of ejecting data distributed to the ejection opening array other than the ejection opening arrays positioned at the both ends.

In a second aspect of the present invention, an ink jet printing apparatus for performing printing on a printing medium by using a printing head having a plurality of ejection opening arrays each having a plurality of ejection openings for ejecting the same color ink arranged, the ejection opening arrays being arranged along a direction intersecting with an arrangement direction of the ejection openings, is provided. The plurality of ejection opening arrays includes ejection opening arrays positioned at both ends in a direction intersecting with an arrangement direction of the ejection openings and ejection opening arrays other than the ejection opening arrays locating at the both ends, and ratio of ejecting data distributed to each of the ejection opening arrays positioned at the both ends is smaller than ratios of ejecting data each distributed to the ejection opening arrays other than the ejection opening arrays positioned at the both ends.

In a third aspect of the present invention, an ink jet printing method for performing printing on a printing medium by using a printing head having a plurality of ejection opening arrays each having a plurality of ejection openings for ejecting the same color ink arranged, the ejection opening arrays being arranged along a direction intersecting with an arrangement direction of the ejection openings, is provided. The plurality of ejection opening arrays includes ejection opening arrays positioned at both ends in a direction intersecting with an arrangement direction of the ejection openings, and at least one ejection opening array other than the ejection opening arrays positioned at the both ends, and ratio of ejecting data distributed to each of the ejection opening arrays positioned at the both ends is smaller than ratio of ejecting data distributed to the ejection opening arrays other than the ejection opening arrays positioned at the both ends.

According to the present invention, positional deviation of printing due to the distance between ejection openings is made inconspicuous so as to enable high quality printing to be achieved.

Further features of the present invention will become apparent from the following description of exemplary embodiments with reference to the attached drawings.

BRIEF DESCRIPTION OF THE DRAWINGS

FIG. 14 is a graph showing deviation of printing due to conveyance variation of the printing medium, or the like.

DESCRIPTION OF THE EMBODIMENTS

First Embodiment

Hereinafter, a first embodiment of the present invention will be described in detail with reference to drawings.

(Entire Configuration)

Figure 1:
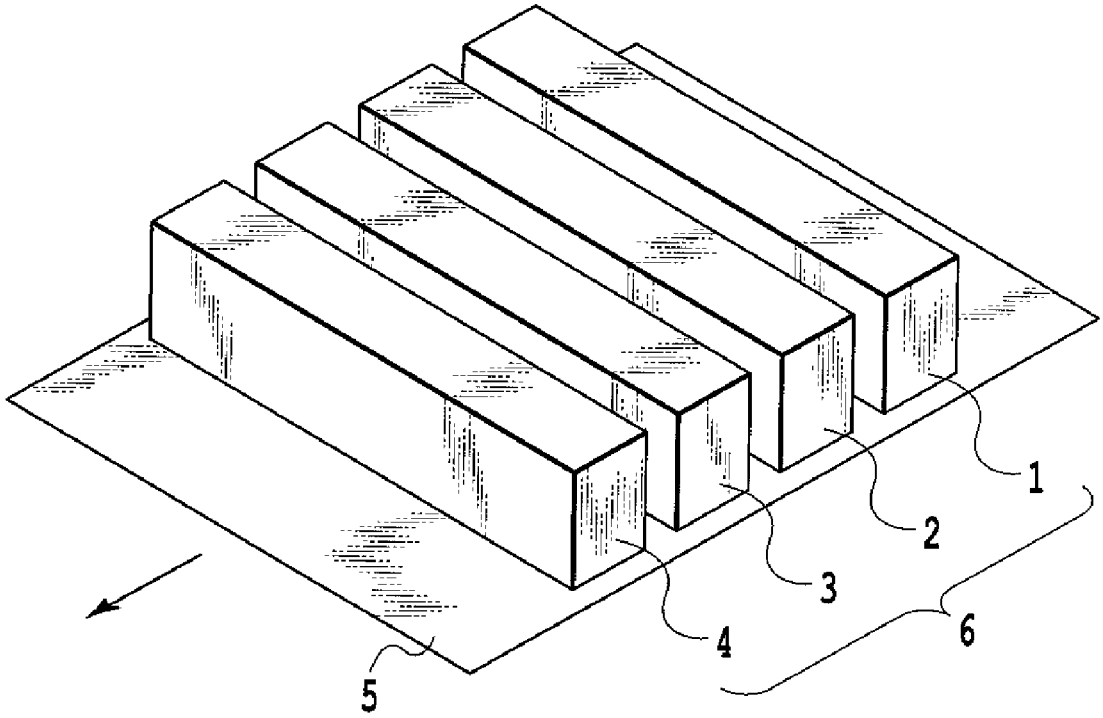
FIG. 1 is a perspective view illustrating a conceptual configuration of an ink jet printing apparatus.

FIG. 1 is a perspective view showing a conceptual constitution of an ink jet printing apparatus relating to one embodiment of the present invention. A head unit 6 is constituted by a plurality of long printing heads 1, 2, 3, and 4, and a plurality of ejection openings equipped with printing elements therein (not shown) is provided in each of the printing heads 1, 2, 3, and 4. The plurality of ejection openings is arranged across the entire width of a printing region. The printing heads 1, 2, 3, and 4 are the long printing heads for ejecting inks of black (K), cyan (C), magenta (M), and yellow (Y), respectively. An ink supply tube not shown is connected to each of the printing heads 1, 2, 3, and 4, and furthermore, control signals and the like are sent through a flexible cable not shown.

A printing medium 5 such as plain paper or high quality exclusive paper, OHP sheet, glossy paper, glossy film, and postal card is conveyed in an arrow direction (main scanning direction) with driving of a conveyance motor while being sandwiched by conveyance rollers, paper ejecting rollers or the like not shown. When the printing is performed, each of the printing heads 1, 2, 3, and 4 of the present embodiment is in a state of being fixed without changing the position, and the printing is performed by moving the printing medium 5 only. In other words, printing is performed by ejecting ink from the printing head during conveying the printing medium.

In a liquid passage communicating with the ejection opening, a heater element (electric/thermal energy converter) generating thermal energy utilized for ink ejecting is provided. The heat of this heater element causes film boiling of the ink, and the ink is ejected from the ejection opening by a pressure of air-bubble generated at that time. When performing the printing, the ink is adhered on the printing medium 5 by ejecting ink droplets from the ejection opening in such a way that the heater element is driven based on a printing signal in time with a reading timing of linear encoder (not shown) detecting a conveyance position of the printing medium 5. A picture or character can be printed by the ink droplets impacted on the printing medium 5.

The printing heads 1, 2, 3, and 4 are sealed in a formation face of the ejection opening with a cap portion of a capping unit not shown when the printing is not performed. This prevents an adhesion of the ink caused by an evaporation of solvent contained in the ink, or a clogging of the ejection opening caused by a foreign body such as dust. The cap portion of the capping unit can be also utilized for an empty ejecting (also called preliminary ejecting) for solving a ejection failure or clogging of the ink ejection opening with a low frequency of use, namely, for ejecting the ink not contributed to the printing toward the cap portion from the ink ejection opening. Furthermore, the ejection opening with ejection failure caused can be recovered by introducing a negative pressure generated by a pump not shown within the cap portion conditioned in capping to absorb and eject the ink from the ejection openings of the printing head. Also, the formation face of the ink ejection opening in the ink jet head can be cleaned (wiped) by arranging a blade (wiping member) not shown in a position adjacent to the cap portion.

Figure 2:
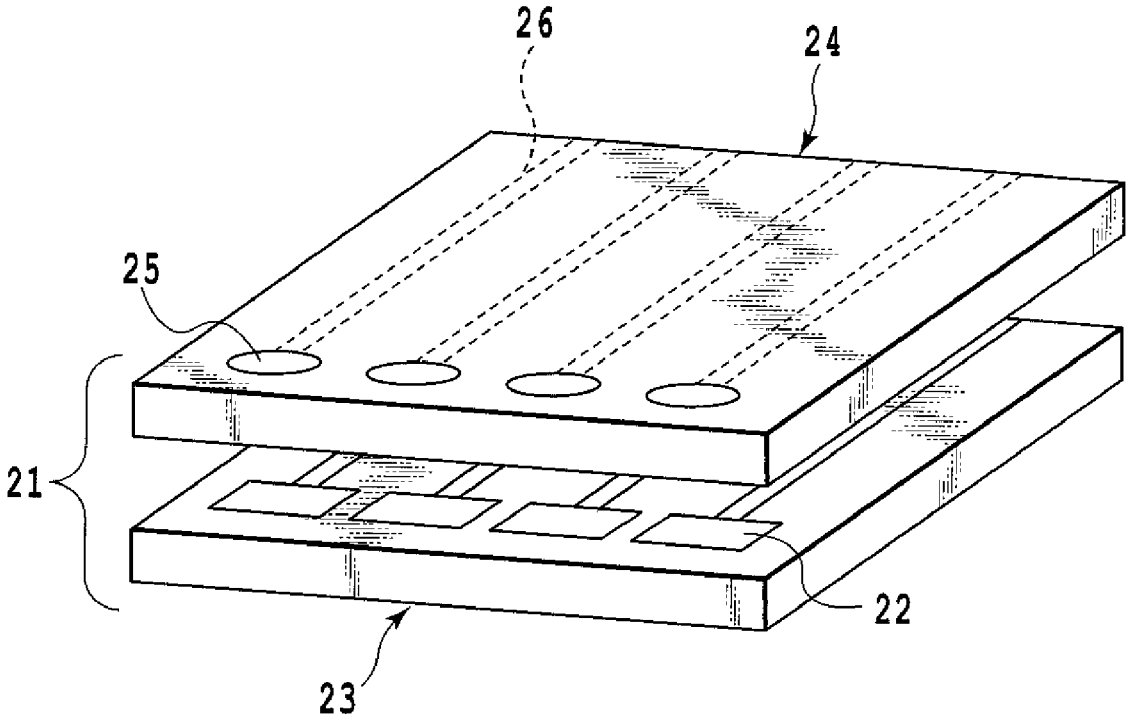
FIG. 2 is an exploded perspective view illustrating a configuration of a main portion of a printing head.

FIG. 2 is an exploded perspective view showing a constitution of an essential part of the printing heads 1, 2, 3, and 4. An ink jet printing head 21 is constituted, as major members, by a heater board 23 being a substrate in which a plurality of heaters (heater elements) 22 for heating the ink is formed, and a top plate in which a plurality of ejection openings 25 corresponding to the heaters 22 of this heater board 23. In the top plate 24, tunnel-like liquid passages 26 communicating with each of ejecting ports 25 is formed, and the liquid passages 26 are connected to one ink liquid chamber (not shown). Furthermore, the ink is supplied to the ink liquid chamber through an ink supply port (not shown), and the supplied ink is supplied to each liquid passage 26 from the ink liquid chamber. In FIG. 2, four units of the ejection opening 25, heater 22, and liquid passage 26 are shown in representation, and the heaters 22 are arranged one by one by corresponding to respective liquid passages 26. In the ink jet head 21 assembled as shown in FIG. 2, the ink on the heater 22 is boiled to form air bubbles by supplying a predetermined drive pulse to the heater 22, and the ink is pushed out and ejected from the ejection opening 25 by a volume expansion of the air bubbles.

Furthermore, an ink jet printing method to which the present invention can be applied is not limited to only the bubble jet (trademark) method using the heater element shown in FIG. 1 and FIG. 2. For example, the present invention can be applied to an ink ejecting method such as a charge control type, or divergence control type in the case of continuous type ejecting the ink droplets continuously, or to a pressure control method of ejecting the ink droplets using piezoelectric vibration elements in the case of on-demand type ejecting the ink droplets as needed. As described above, the present invention can be applied to the printing head equipped with various ink jet printing elements.

Figure 3:
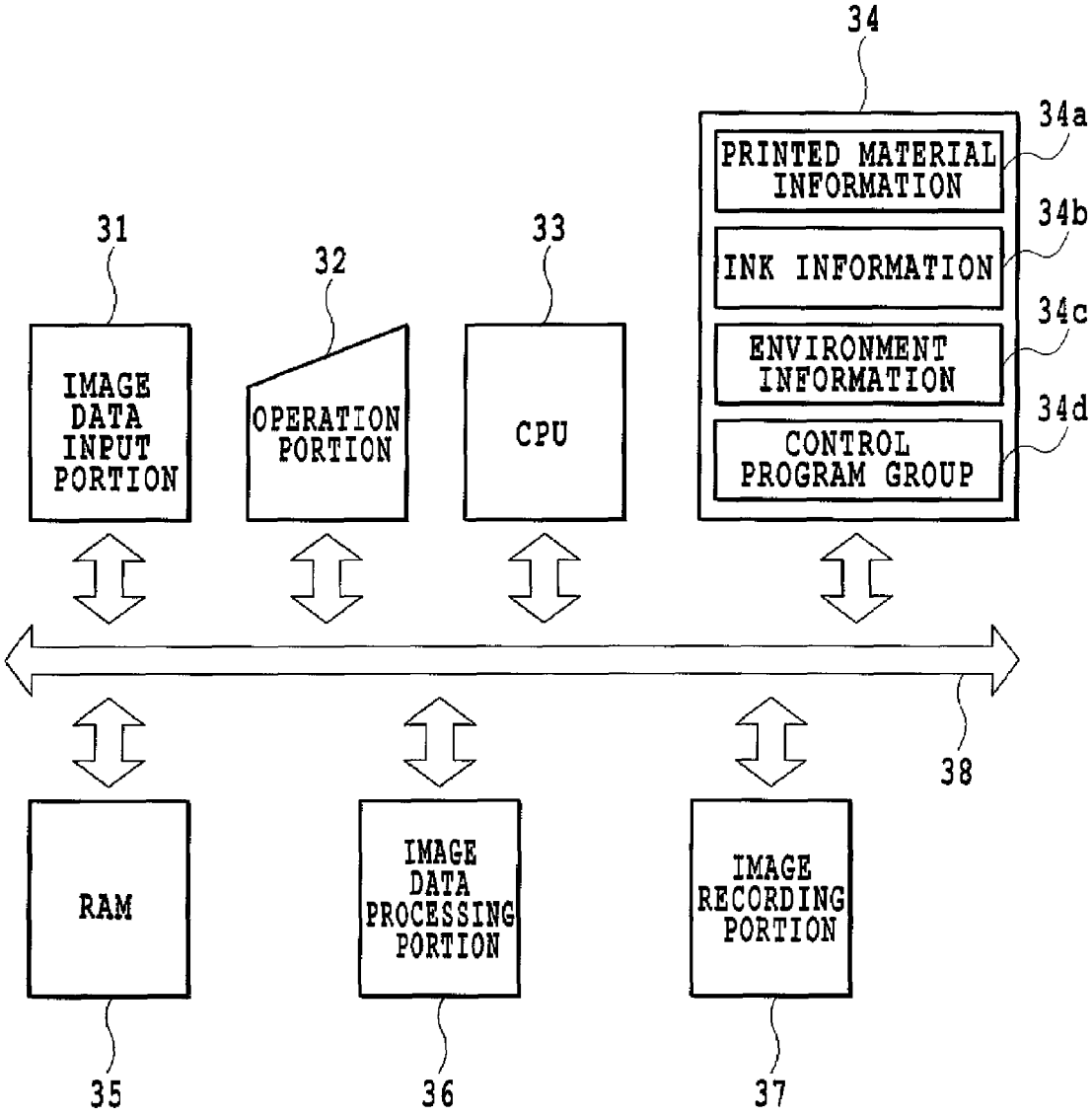
FIG. 3 is a block diagram illustrating a configuration example of a control system of an ink jet printing apparatus.
Figure 4:
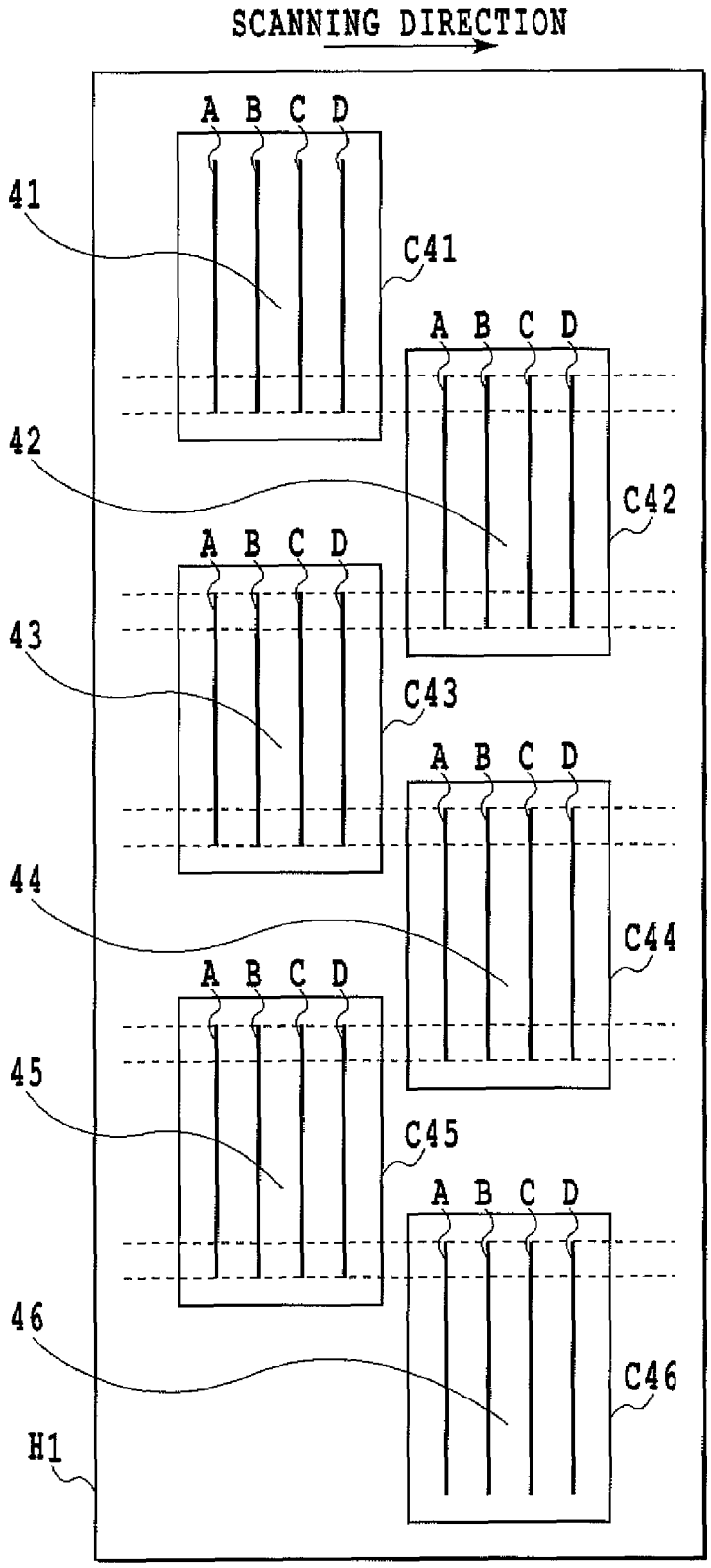
FIG. 4 is an outline view illustrating a configuration of a full line type long printing head.

FIG. 3 is a block diagram showing a constitution example of control system in the ink jet printing apparatus of the present embodiment. A reference numeral 31 denotes an image data input portion, 32; a control portion, 33; a CPU portion performing various processes, and 34; a storage medium storing various data. In a print information storing memory of the storage medium 34, information 34*a* chiefly regarding sorts of the printing medium, information 34*b* regarding the ink used for printing, and information 34*c* regarding atmosphere such as temperature, moisture at the time of printing. A reference numeral 34*d* denotes various control program group. Furthermore, 35 is a RAM, 36 is an image data processing portion, 37 is an image printing portion outputting images, and 38 is a bus portion transferring various data.

As mentioned in further detail, into the image data input portion 31, multi-value image data from an image input apparatus such as a scanner, or a digital camera, or the multi-value image data stored in a hard disk of personal computer or the like is input. The control portion 32 includes various keys setting various parameters and instructing a start of the printing. The CPU 33 controls the whole of the present printing apparatus according to various programs in the storage medium. The storage medium 34 stores a program and the like for operating the present printing apparatus according to a control program, or an error processing program. All operations of the present examples are controlled by this program. As the storage medium 34 storing the program like this, a ROM, an FD, a CD-ROM, an HD, a memory card, and a magnetic optical disc can be utilized. The RAM 35 is used as a work area of various programs in the storage medium 34, a temporary save area at the time of error processing, and a work area at the time of image processing. Furthermore, after various tables in the storage medium 34 are copied to the RAM 35, the tables are modified, and an image processing can be advanced while referring to the modified tables.

The image data processing portion 36 quantizes the input multi-value image data into N-value image data for each pixel, and then, based on a gradation value "N" indicated by each quantized pixel, selects a dot arrangement pattern corresponding to the gradation value. The dot arrangement pattern is a binary pattern indicating presence/absence of dot printing and therefore, binary ejection data can be obtained by selection of the dot arrangement pattern. After performing N-value processing on the input multi-value image data, the image data processing portion 36 generates binary ejection data based on the N-value image data. For example, when the multi-value image data represented by eight bits (256 gradations) is input into an image data input portion 31, the gradation value of the output image data in the image data processing portion 36 is quantized into 25 (=24+1) values. Next, the dot arrangement pattern is assigned to the 25-value image data in the image data processing portion 36, thereby generating binary ejection data indicating ink eject/non-eject. Thereafter, the binary ejection data is distributed to a plurality of ejection opening arrays before binary ejection data corresponding to the ejection opening of each ejection opening array being determined. Incidentally, in the present example, although a multi-value error diffusion method is used for N-value process of the input gradation image data, in addition to this, for example, a mean density reservation method, a dither matrix method, or any half tone processing method can be used. Further, the image data processing portion 36 has only to be able to finally generate binary ejection data from multi-value image data and, as mentioned above, an interposition of the N-value process is not indispensable. For example, the binary process may be performed so that the multi-value image data input into the image data processing portion 36 is directly converted into binary ejection data. An image printing portion 37, based on the binary ejection data generated in the image data processing portion 36, forms a dot image on the printing medium by ejecting the ink from the corresponding ejection opening 25. The bus line 38 transmits an address signal inside the present apparatus, the data, and the control signal.

Next, an arrangement of the ejection opening and its drive and an actual printing operation using the printing head will be described. In the present embodiment, the binary ejection data to be printed with the printing head per ink color was generated in such a way that the input image data is subjected to color separation so that it may correspond to the printing head per ink color, and each color multi-value image data subjected to the color separation is binary processed by the error diffusion method.

The long printing head H1 of the present embodiment is constituted from chip-like constituent components (hereinafter, merely referred to as a chip) C41, C42, C43, C44, C45, and C46 relatively short in length in a ejection opening arrangement direction (first direction). The long printing head H1 is formed by arranging these chips in zigzag manner in the ejection opening arrangement direction (first direction).

The chip C41 includes four ejection opening arrays (array A, array B, array C, and array D) ejecting the same color ink, and each array has a plurality of ejection openings arranged in a resolution of 1200 dpi. Furthermore, the ejection openings of the ejection openings arrays adjacent to each other in the main-scanning direction (second direction) intersecting with the ejection opening arrangement direction (first direction) are provided in a condition in which the arrangement pitch is shifted by a half pitch in the ejection opening arrangement direction. Namely, the ejection openings of adjacent ejection opening arrays are arranged in a condition in which ejection openings of one ejection opening array are positioned being shifted by $1/2400$ inch from ejection openings of the other ejection opening array along the ejection opening arrangement direction. Accordingly, adjacent ejection opening arrays will print different rasters shifted by $1/2400$ inch in the ejection opening arrangement direction and therefore, the printing resolution in the ejection opening arrangement direction is 2400 dpi. On the other hand, the same raster is printed by a combination of the array A and array C or a combination of the array B and array D and therefore, the printing resolution for the same raster is 1200 dpi. Specifically, the raster (first raster) printed by the combination of the array A and array C is a raster printed only in odd columns and its printing resolution is 1200 dpi. The raster (second raster) printed by the combination of the array B and the array D is a raster printed only in even columns and its printing resolution is 1200 dpi. Thus, since the odd columns and even columns have each a printing resolution of 1200 dpi, combining both produces a printing resolution of 2400 dpi. This 2400 dpi is the resolution in the main-scanning direction. Incidentally, the first raster and the second raster exist alternately in the ejection opening arrangement direction and thus the resolution in the main-scanning direction is defined by combining two adjacent rasters as a set. With the above constitution, as a printing resolution, 2400 dpi in the main-scanning direction (conveying direction), and 2400 dpi in the sub-scanning direction (ejection opening arrangement direction) can be realized.

Figure 5:
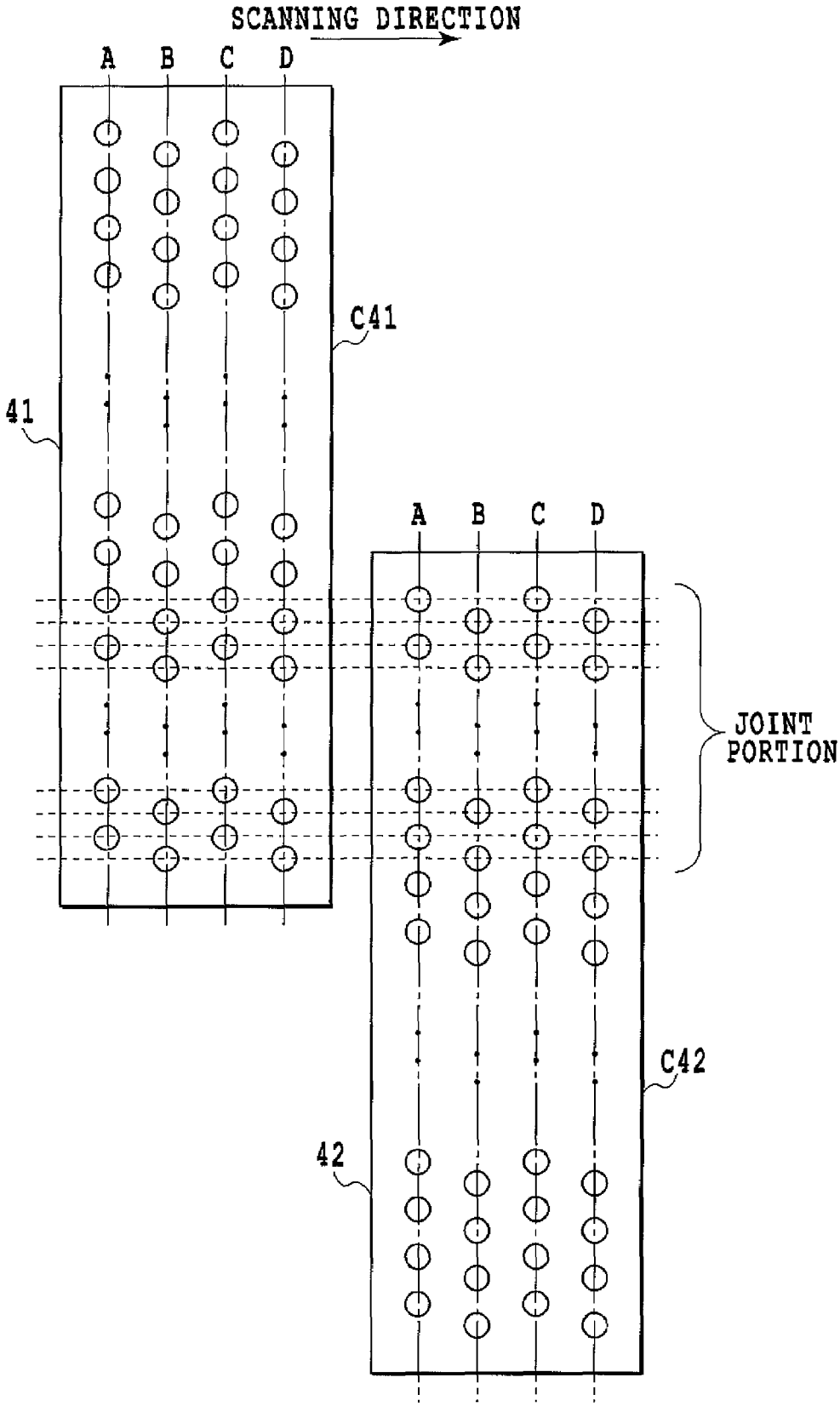
FIG. 5 is a schematic diagram illustrating a state of ejection opening arrays of chips in FIG. 4 in detail.

FIG. 5 is a schematic diagram showing in detail a condition of the ejection opening arrays of the chip C41 and the chip C42. As shown in FIG. 5, the chip C41 and the chip C42 are arranged so that predetermined ejection openings may be overlapped each other in the scanning direction (this overlapped portion is called joint portion, on the other hand, a portion except the joint portion is called non-joint portion). The arrangement like this reduces white stripes on the printing medium corresponding to a location of joint between chips themselves. In the present embodiment, the ejection openings between the chip C41 and the chip C42 are arranged so that the ejection openings from a port positioned at an end in the ejection opening arrays to the ejection openings of 32 units may be overlapped each other in the ejection opening array direction.

(Characteristic Constitution)

In the present embodiment, in order to reduce uneven density caused by impact location displacement due to the distance between the ejection opening arrays as much as possible, the ejection data assigning ratio for each plurality of ejection opening arrays is changed from ejection opening array to ejection opening array.

Figure 6:
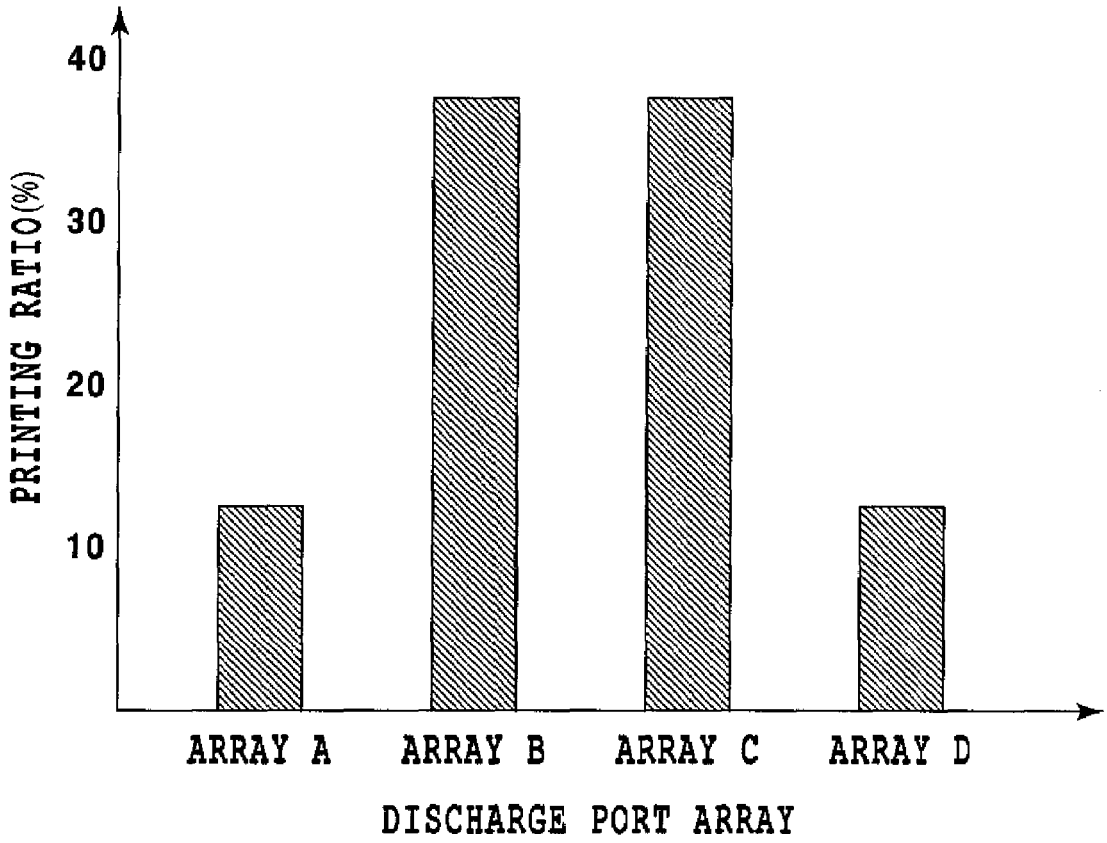
FIG. 6 is a graph showing a data assigning ratio for each ejection opening array.

FIG. 6 is a view where the data assigning ratio for each ejection opening array constituting the non-joint portion in the present embodiment is shown in a graph. As is clear from the figure, the data assigning ratio for each array of the present embodiment is as follows; array A:array B:array C:array D=1:3:3:1. Specifically, the data assigning ratio for the array A and array D is each 12.5% and that for array B and array C is each 37.5%. Like the non-joint portion, the data assigning ratio for each ejection opening array constituting the joint portion is assumed to be array A:array B:array C:array D=1:3:3:1. However, the data assigning ratio itself of the joint portion is half that of the non-joint portion. Namely, in both chips constituting the joint portion, the data assigning ratio for the array A and array D is each 6.25% and that for the array B and array C is each 18.75%.

Figure 14:
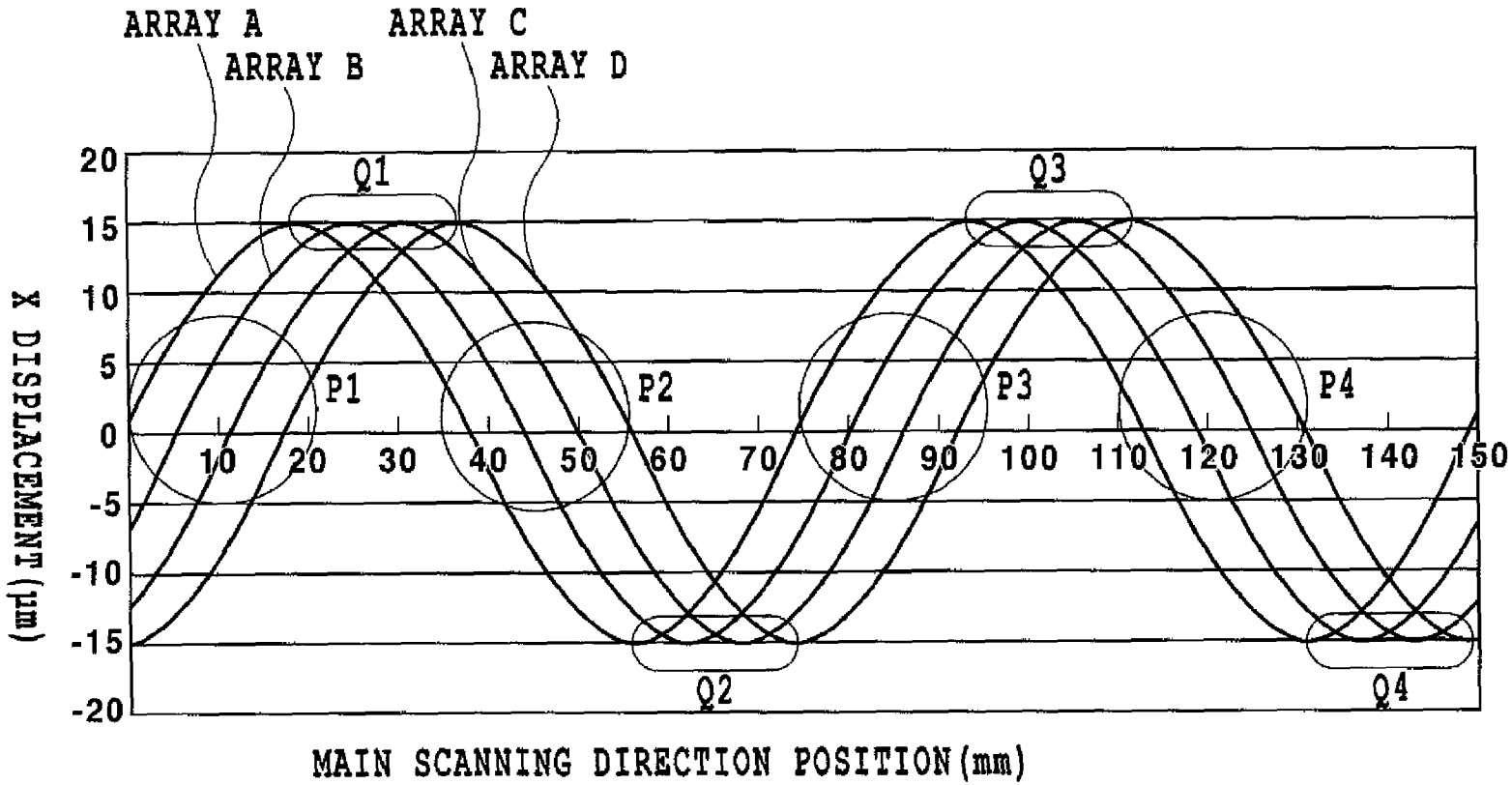
Figure 15:
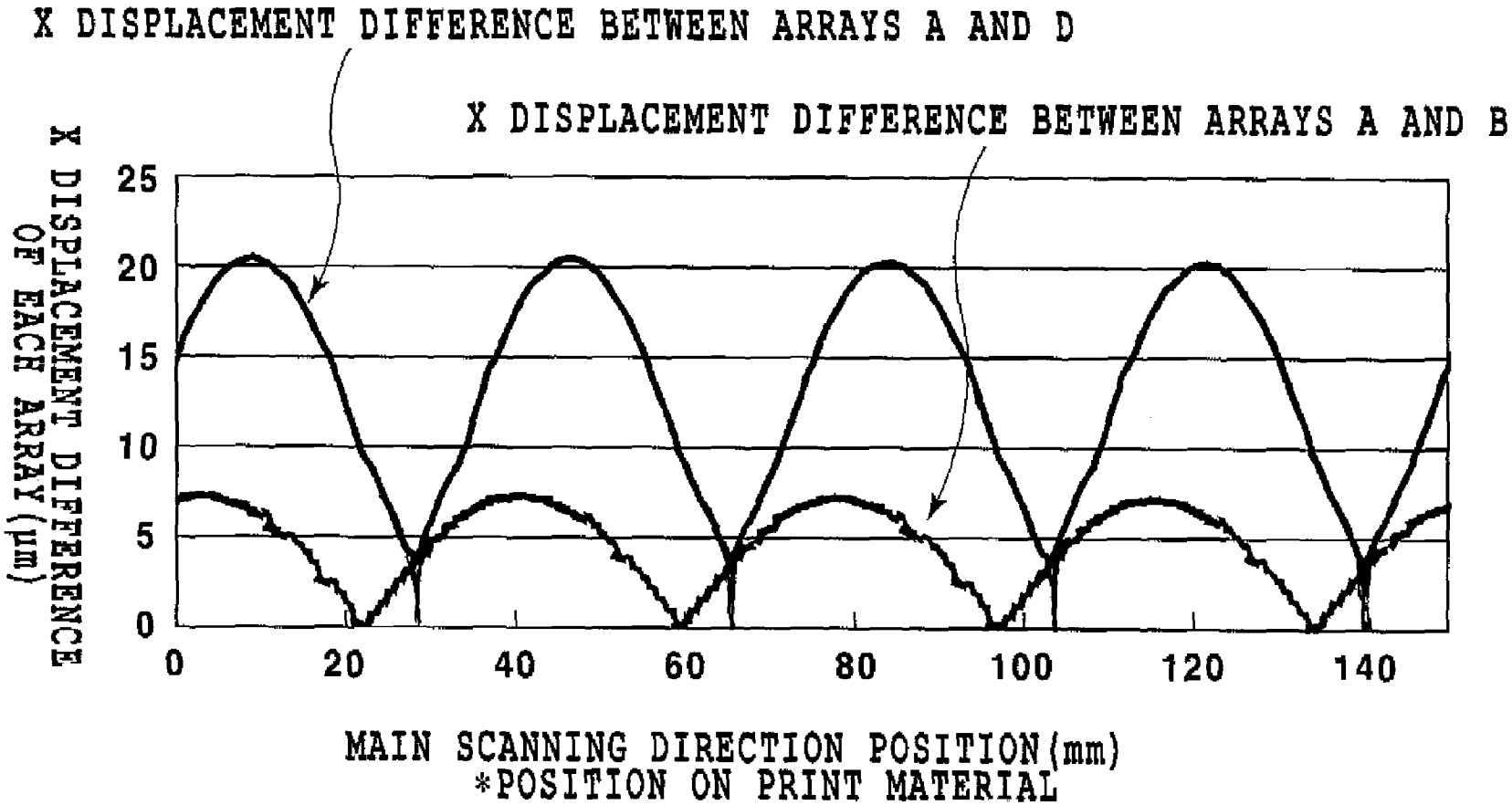
FIG. 15 is a view where differences of X displacement are shown in a graph.

In processing data, data is distributed so that the data assigning ratio becomes this ratio when image data after binary process (binary ejection data) is allocated to each array. In this manner, in the present embodiment, the data assigning ratio of ejection opening arrays (array A, array D) positioned at both ends and that of ejection opening arrays (array B, array C) other than the ejection opening arrays positioned at both ends are different. Accordingly, the ratio of dots printed by specific ejection opening arrays (here, array B, array C) increases. Then, impact displacement of dots printed by different ejection opening arrays described in FIG. 14 decreases, thereby enabling occurrence of uneven density described in FIG. 14 to be suppressed. Particularly in FIG. 6, since the distribution ratio of arrays A and D at both ends where the distance between ejection opening arrays is large is set relatively low and that of central arrays B and C where the distance between ejection opening arrays is small is set relatively high, uneven density described in FIG. 15 can be suppressed. Moreover in FIG. 6, since ejection data is distributed to a plurality of ejection opening arrays A to D, instead of distributing ejection data only to a single ejection opening array, a so-called multi-pass effect in which one raster is printed by a plurality of ejection openings can also be obtained.

Figure 7:
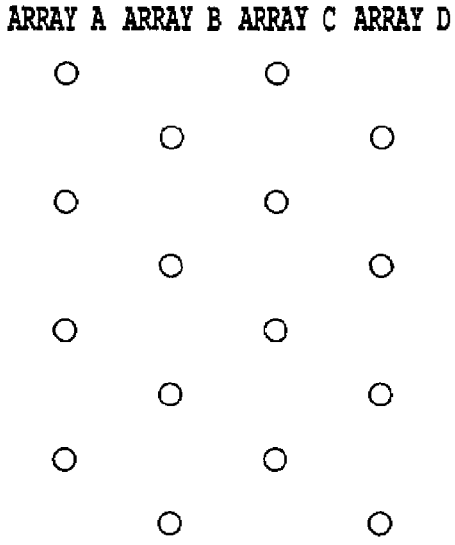
FIG. 7 is a diagram illustrating a specific example of mask for achieving data distribution in FIG. 6.

FIG. 7 is a diagram showing a specific example of mask for realizing the data distribution in FIG. 6 by associating with the ejection opening arrays of the head. A right side in the diagram is an image diagram of mask showing that the data is distributed to which ejection opening array, among A, B, C, and D, for each pixel position and "A" indicates that data is distributed to the ejection opening array A. Since the ejection data is distributed according to the above-mentioned data assigning ratio, in a raster (first raster) in which the printing is performed by the array A and array C as shown in the diagram, the distribution is performed three times successively to the ejection openings of array C after the distribution is performed once to the ejection openings of the array A. Similarly, in a raster (second raster) in which the printing is performed by array B and array D, the distribution is performed three times successively to the ejection openings of array B after the distribution is performed once to the ejection openings of the array D. This decreases a ratio of adjacent dots printed by the arrays with a long interval (for example, the array A and array C) by increasing a continuous printing by the array C or the array B. This can realize the printing in which the number of portions with impact locations displaced is small.

Incidentally, FIG. 7 shows as if the printing position of the first raster in the main-scanning direction and that of the second raster are the same. Actually, however, the printing position of the first raster in the main-scanning direction and that of the second raster are shifted by one column as mentioned above, and the first raster is a raster in which odd columns are printed and the second raster is a raster in which even columns are printed. Therefore, in FIG. 9, mask portions (portions denoted by A and C) corresponding to the first raster show distribution destinations of ejection data corresponding to odd columns. Similarly, mask portions (portions denoted by B and D) corresponding to the second raster show distribution destinations of ejection data corresponding to even columns.

By the way, using only the array C and array B can be thought to realize the printing with less displacement of the impact locations. However, in that case, when a failure ejection opening is generated in the array C or array B, the raster corresponding to the failure ejection opening cannot be used. When a failure ejection opening is generated, locations that should originally be printed by the failure ejection opening must be printed by another normal ejection opening. Therefore, in the present embodiment, instead of using only the array B and array C, the array A that can print the same raster as the array C and the array D that can print the same raster as the array B are also used in order to be able to deal with the above-mentioned situation.

Moreover, to consider realizing the printing with fewer portions in which the impact location is displaced, a data assigning ratio different from the above-mentioned data assigning ratio may be used. When, for example, array A:array B:array C:array D=1:X:X:1, X can be thought to take 2, 4, 5, or a still larger value and the mode of $X \geqq 2$ is the category of the invention. However, the multi-pass effect is reduced as the value of X increases and also life differences among ejection opening arrays increase. In the present embodiment, array A:array B:array C:array D=1:3:3:1 is set as the optimum data assigning ratio in consideration of the above phenomena.

Further, the data assigning ratio of the array A and that of the array D may not be the same, and the data assigning ratio of the array B and that of the array C may not be the same. However, the total of the data assigning ratio of the array A and that of the array C printing the same raster must be 50%, and similarly, the total of the data assigning ratio of the array B and that of the array D printing the same raster must also be 50%.

Within an area shown in the FIG. 7, the pixel positions printed by the ejection openings of the array A are eight portions, the pixel positions printed by the ejection openings of the array B are 24 portions, the pixel positions printed by the ejection openings of the array C are 24 portions, and the pixel positions printed by the ejection openings of the array D are eight portions. This shows that array A:array B:array C:array D=1:3:3:1 as with the above-mentioned data assigning ratio. Furthermore, although an example of relatively monotonous pattern is shown for facilitating understanding of the description here, the data assigning ratio of each array has only to be the above-mentioned ratio as a whole, and the mask pattern is not limited to the pattern in FIG. 7.

Example

In this example, the printing head H1 was driven so that the ejecting amount of ink droplet from one ejection opening was 2.8 pl. Moreover, the drive frequency for ejecting ink droplet was set to 8 kHz and the printing resolution was set to 2400 dpi (main-scanning direction, conveying direction) X 2400 dpi (sub-scanning direction, ejection opening arrangement direction). Moreover, ink jet exclusive photo glossy paper (Pro Photopaper PR-101; manufactured by CANON Inc.) was prepared as the printing medium 5. Moreover, BCI-7 ink for a commercially available ink jet printer PIXUS iP7100 (manufactured by CANON Inc.) was used as ink. In addition, as test image data, patch image data including portions whose printing duty is 100%, 75%, 50%, and 25% were prepared. In addition, photographic image data including various duties other than the above-mentioned four duties was prepared.

Figure 8:
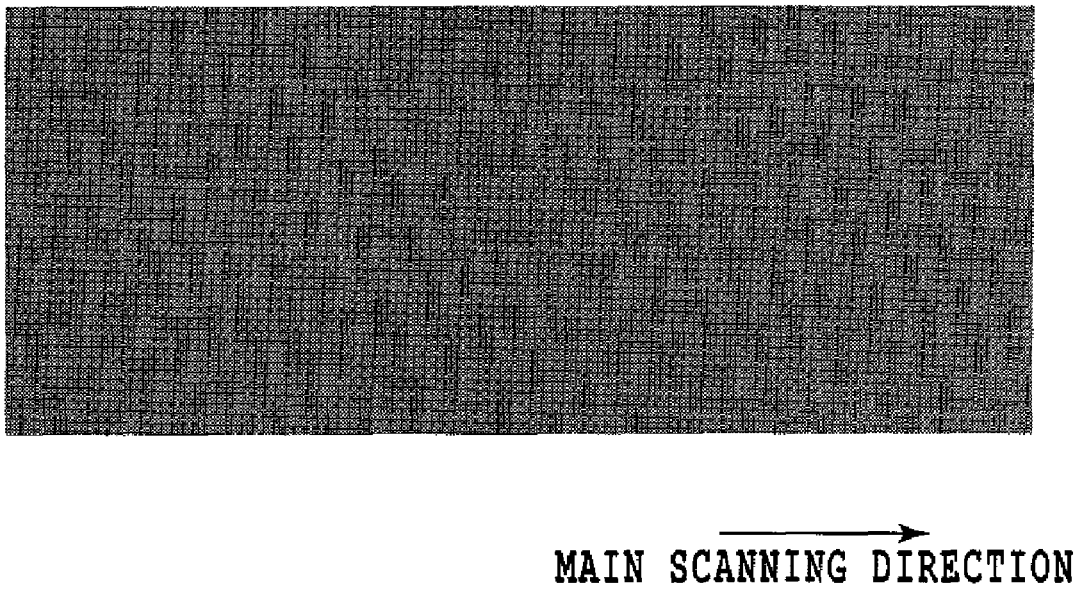
FIG. 8 is a view illustrating result of printing according to the data assigning ratio in FIG. 6.

The printing was performed under the condition as mentioned above. Specifically, binary ejection data was generated from the prepared image data and the binary ejection data was distributed to the array A, the array B, the array C, and the array D in a ratio of 1:3:3:1. This distribution ratio was the same for both the joint portion and the non-joint portion. Then, ink was ejected from the array A, the array B, the array C, and the array D according to the distributed ejection data to print patch images and photographic images. As a result, images with satisfactory image quality could be printed where uneven density with respect to the main scanning direction was hardly seen, and degradation of image quality is not seen. FIG. 8 is a view illustrating, among patch images obtained in the present example, a printing result in a portion whose printing duty is 50%, showing clearly that there is no uneven density.

In the present example, as described above, the data assigning ratio for a plurality of ejection opening arrays for ejecting the same ink is changed among ejection opening arrays. Specifically, the data assigning ratio for ejection opening arrays (the array B and the array C) with a smaller distance between ejection opening arrays is made relatively higher and the data assigning ratio for ejection opening arrays (the array A and array D) with a larger distance between ejection opening arrays is made relatively lower. Accordingly, high quality printing in which uneven density accompanying impact displacement is suppressed can be achieved by making displacement in impact positions depending on the distance between the ejection opening arrays inconspicuous.

Comparative Example

Figure 9:
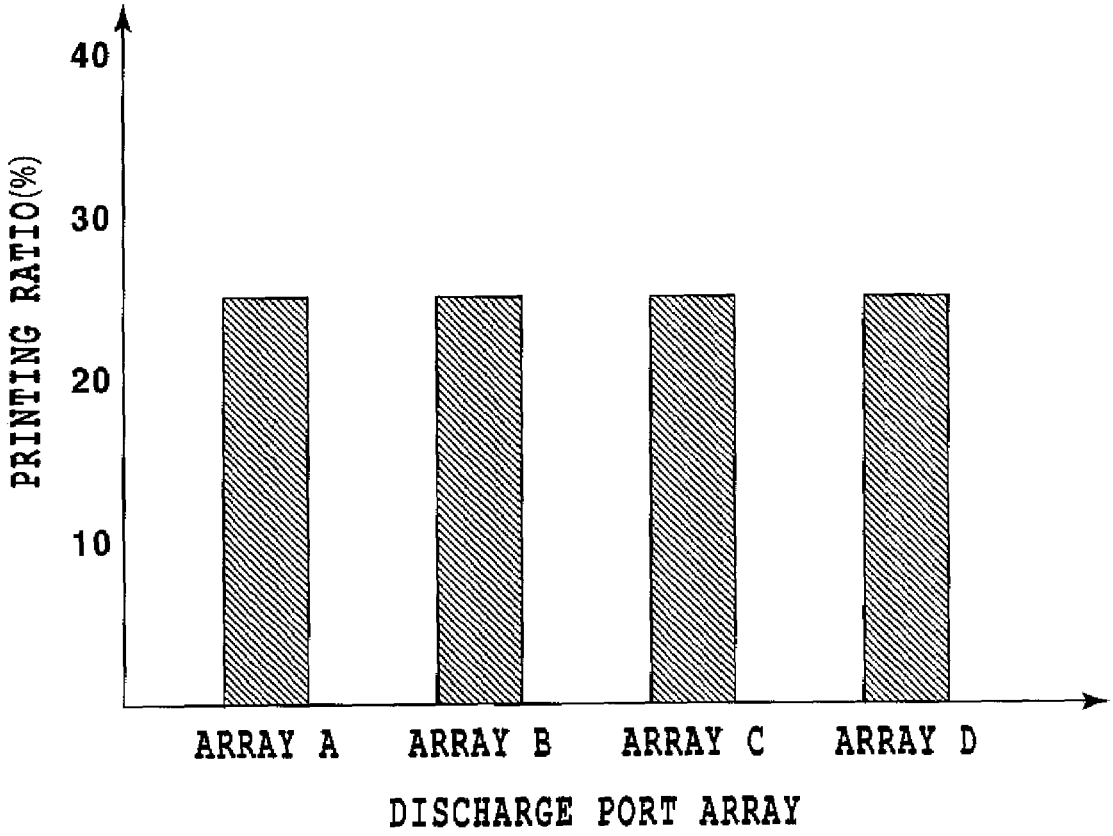
FIG. 9 is a graph showing a data assigning ratio for each ejection opening array in a comparative example.

FIG. 9 is a view illustrating a comparative example for being compared with the example of the present invention. In this comparative example, the view shows a graph representing the data assigning ratio of each ejection opening array. Here, data assigning ratio of each ejection opening array at a non-joint portion is shown, and the data assigning ratio of four rows of rows A, B, C and D is 1:1:1:1. For all of the four arrays, 100% of printing is performed. Specifically, the data assigning ratio of each array is 25%. For all of the four arrays, 100% of printing is performed. At a joint portion, on the other hand, data is distributed uniformly to each array in the data assigning ratio of 12.5%.

Figure 10:
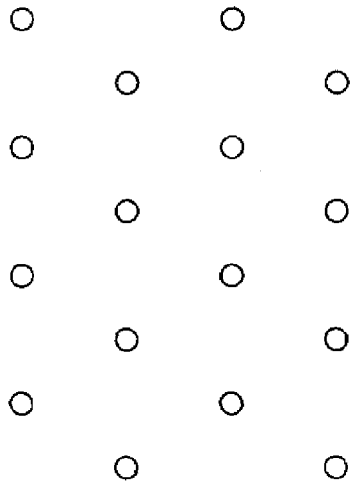
FIG. 10 is a diagram illustrating a specific example of mask for achieving data distribution in FIG. 9.

FIG. 10 is a view illustrating a specific example of mask for achieving data distribution in FIG. 9 while associating it with the ejection opening arrays of the head. A right side in the figure illustrates to which ejection opening array among the arrays A, B, C and D data is distributed for each pixel position. Pixel positions printed at each ejection opening of the arrays A, B, C and D are all 16 respectively, and exactly as the above mentioned data assigning ratio of each array is 1:1:1:1.

Figure 11:
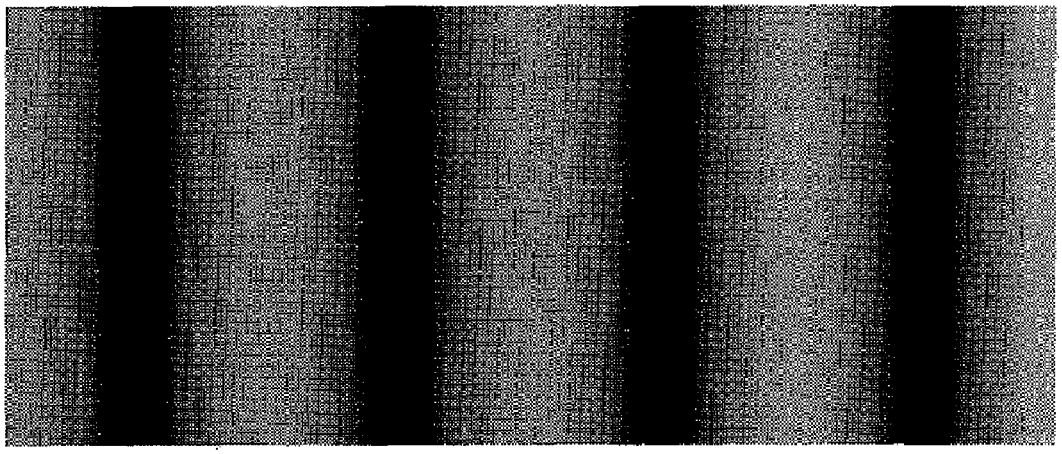
FIG. 11 is a view illustrating result of printing according to the data assigning ratio in FIG. 9.

FIG. 11 is a printing result when printing is performed under the condition as mentioned above, and enables occurrence of uneven density in the main scanning direction to be confirmed.

According to the present embodiment, as described above, among a plurality of ejection opening arrays, specific ejection opening arrays and other ejection opening arrays are made to have different data assigning ratios. More specifically, while the data assigning ratio for specific ejection opening arrays (arrays B and C) positioned centrally is made relatively higher, the data assigning ratio for other ejection opening arrays (arrays A and D) than the specific ejection opening arrays positioned at both ends is made relatively lower. Accordingly, printing displacement by different ejection opening arrays is reduced for an increased printing rate by the specific ejection opening arrays, resulting in reduced uneven density.

Second Embodiment

Like the first embodiment, the present embodiment makes the data assigning ratio for specific ejection opening arrays differ from that for other ejection opening arrays, but which array to be made to have a different data assigning ratio is different from the first embodiment. The present embodiment is similar to the first embodiment except the way of making the data assigning ratio different from each other.

In the present embodiment, like the first embodiment, the data assigning ratio for specific ejection opening arrays is made relatively higher and the data assigning ratio for ejection opening arrays other than the specific ejection opening arrays is made relatively lower. The difference between the present embodiment and the first embodiment is in the positions of specific ejection opening arrays and those of ejection opening arrays other than the specific ejection opening arrays. Namely, in the present embodiment, the specific ejection opening arrays are ejection opening arrays positioned on one side and the ejection opening arrays other than the specific ejection opening arrays are ejection opening arrays positioned on the other side.

For example, the arrays A and B positioned on one side (left side) are defined as specific ejection opening arrays and the arrays C and D positioned on the other side (right side) are defined as other ejection opening arrays than the specific ejection opening arrays. In this case, it is preferable to set the data assigning ratio of four arrays of the array A, array B, array C, and array D to be 3:3:1:1.

As another example, the arrays C and D positioned on one end side (right side) may be defined as specific ejection opening arrays and the arrays A and B positioned on the other end side (left side) are defined as ejection opening arrays other than the specific ejection opening arrays. In this case, the data assigning ratio of four arrays of the array A, array B, array C, and array D is defined as 1:1:3:3.

In both cases of printing in accordance with any of the data assigning ratios, favorable printing results without uneven density can be obtained.

According to the present embodiment, as mentioned above, while the data assigning ratio for specific ejection opening arrays is made relatively higher, the data assigning ratio for ejection opening arrays other than the specific ejection opening arrays is made relatively lower. Accordingly, printing displacement by different ejection opening arrays is reduced for an increased printing rate by the specific ejection opening arrays, resulting in reduced uneven density.

Third Embodiment

The printing head of the present embodiment is different from those of the first and the second embodiment, and it is a serial type printing head chips of each color (C: cyan, M: magenta, Y: yellow, K: black) are provided with four ejection opening arrays, respectively.

Figure 12:
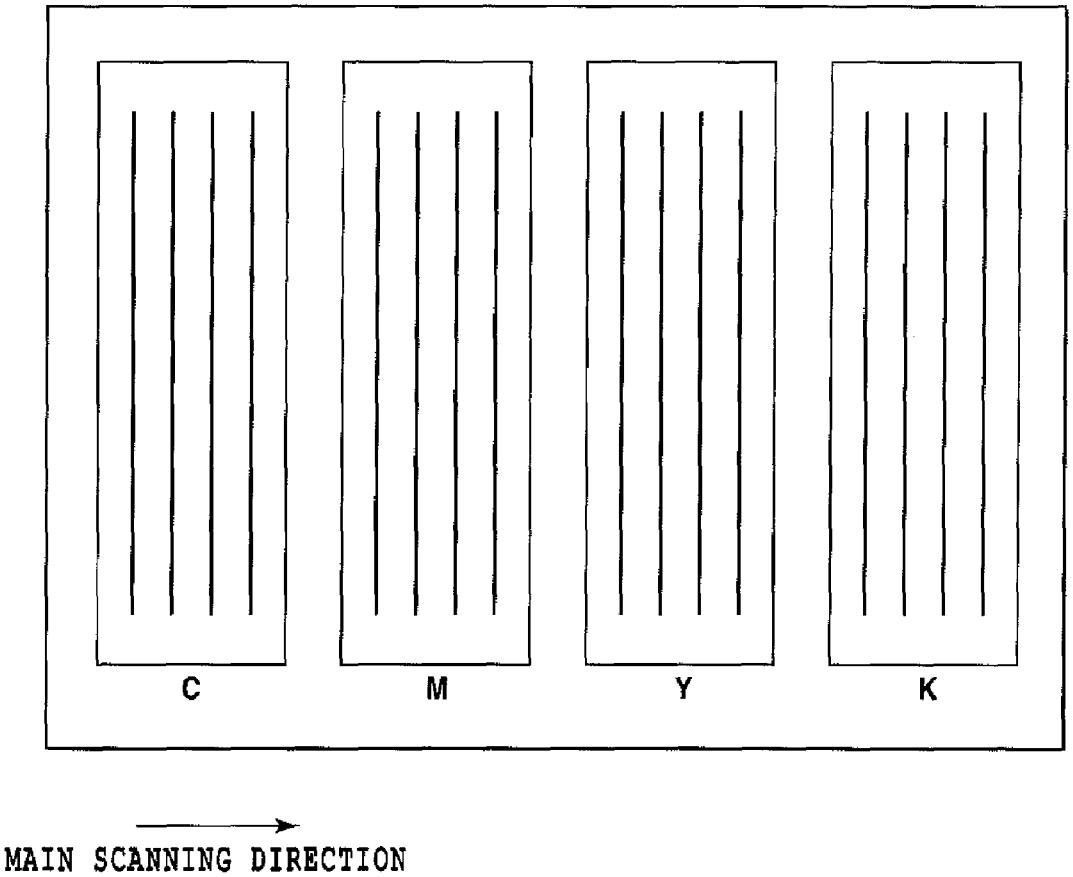
FIG. 12 is a plan view schematically illustrating ejection opening planes of a printing head in a third embodiment.
Figure 13:
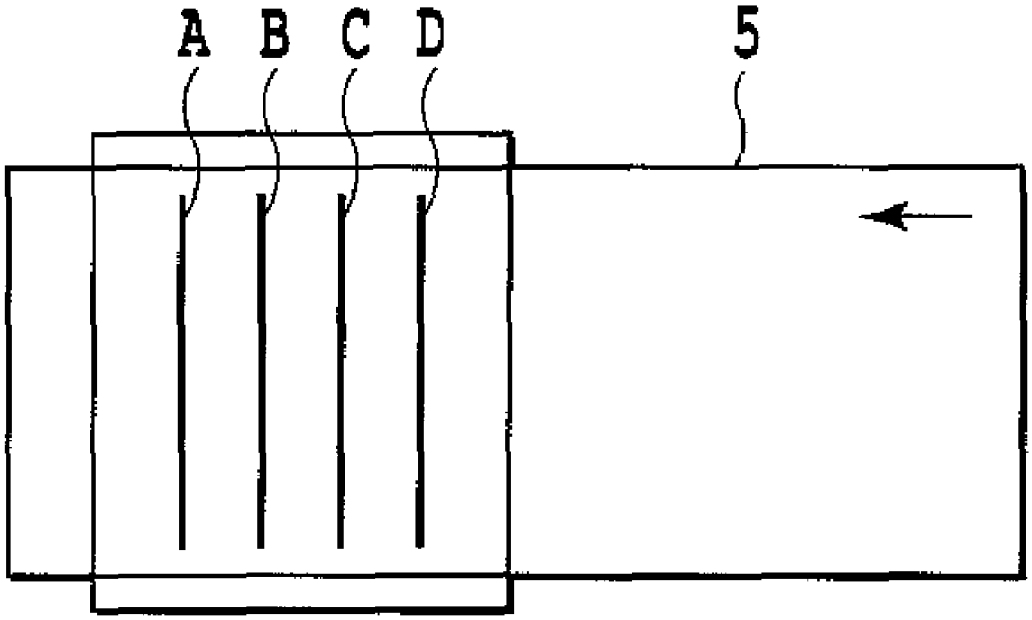
FIG. 13 is a diagram illustrating an aspect where printing is performed on a printing medium by using the printing head.

FIG. 12 is a plan view schematically illustrating ejection opening planes of the printing head of the present embodiment. As shown in the figure, ejection opening arrays are aligned on chips of each color in parallel with a direction (main-scanning direction) intersecting with an arrangement direction of the ejection openings. Such a printing head scans serially on a printing medium, and performs printing of a predetermined width per one scanning, and after that the printing medium is conveyed by a predetermined amount. More specifically, by repeating the main-scanning operation to scan (move) the printing head in the direction intersecting with the arrangement direction of the ejection openings and conveying scanning to convey the printing medium in the direction along the arrangement direction of the ejection openings, the printing on all regions of the printing medium is performed. Further, in the present embodiment, similarly to the first embodiment, for each color, the four ejection opening arrays provided to each chip perform printing at a data assigning ratio of 1:3:3:1.

According to the present embodiment, similarly to the printing result of the first and second embodiments, high quality printing without uneven density can be achieved.

The Other Embodiment

Even a different embodiment other than the above embodiments is allowed, if it does not depart from the scope of the present invention.

Although, in the present embodiment, it is shown that printing in the same raster extending in the main scanning direction is performed by two ejection opening arrays (for example, the arrays A and C in FIG. 7), the present invention is not limited to this and three or more arrays may be used.

For example, in case of three arrays, when arrays α, β and γ are arranged in this order, by setting the data assigning ratio to a ratio such as array α:array β:array γ=1:1:3, uneven density can be prevented from being generated. In order to make the distribution rate for a specific ejection opening array (array γ) differ from that for other ejection opening arrays (arrays α and β) as mentioned above, the specific ejection opening array with a high distribution rate may be one array.

Moreover, similarly in case of three arrays, when arrays α, β and γ are arranged in this order, data assigning ratio may be set so that as array α:array β:array γ=1:2:3, as the distance between arrays becomes larger difference in data assigning ratio in these arrays becomes larger. Similarly, in case of three or more arrays, data assigning ratio may be set so that as the distance between arrays becomes larger difference in data assigning ratio in these arrays becomes larger. When the distribution rate for the specific ejection opening array (array γ) is made to differ from that for the other ejection opening arrays (arrays α and β) as mentioned above, it is sufficient for the distribution rate of the other ejection opening arrays to be lower than that of the specific ejection opening array, and the other ejection opening arrays may have different distribution rates.

Moreover, in the above-mentioned embodiments, ejection openings of adjacent ejection opening arrays are arranged by shifting ejection openings in the ejection opening arrangement direction, but arrangement of the ejection openings by shifting them is not indispensable in the present invention. In order for any ejection opening array to be able to print the same raster, positions of ejection openings in the ejection opening arrangement direction may be the same in each array. For example, if, among arrays A, B, C, and D in FIG. 5, positions of the ejection openings of the arrays B and D are shifted by 1/2400 dpi in the ejection opening arrangement direction while positions of the ejection openings of the arrays A and C remain unchanged, positions of the ejection openings of each array will be the same. In this case, the printing resolution in the ejection opening arrangement direction will be 1200 dpi, which is lower than the printing resolution (2400 dpi) using FIG. 5, but is sufficient for practical use with almost no decrease in printing density.

As the printing head, not only an ink jet printing head equipped with an ink jet printing element which can eject ink from ejection openings, but also a printing head equipped with a various types of printing elements can be used. Moreover, configurations of ejection opening arrays and printing methods applicable to the present invention are not limited to the above mentioned embodiments. Although, these other examples will be enumerated below, they are not limited to these.

Moreover, as mentioned above the present invention may be applied to a system configured by a plurality of apparatuses (for example, a host computer, an interface apparatus, a reader, a printer etc.) or apparatus composed of one device (for example, a copier, a facsimile machine).

Moreover, in order to operate a various types of devices to achieve the functions of the above mentioned embodiments, the computer in an apparatus or a system connected to the various types of devices is fed with a program code for achieving the functions of the embodiments. In addition, an embodiment performed by operating the various types of devices according to the program stored in the computer (CPU or MPU) of the system or the apparatus is also included within the scope of the present invention.

Also in this case, the software program code itself realizes the function of the above-mentioned embodiment. The program code itself, unit for supplying the program code to the computer, for example, and the printing medium storing such program code constitute the present invention.

As the printing medium storing such program codes, for example, a floppy (trademark) disk, a hard disk, an optical disc, a magnetic optical disc, a CD-ROM, a magnetic tape, a nonvolatile memory card, a ROM, and the like can be employed.

Furthermore, the present invention is not limited to the case in which the functions of the above-mentioned embodiments are achieved by the computer executing the program codes supplied. Also, when the program codes realize the functions of the above-mentioned embodiments in cooperation with an OS operated in the computer, other application software or the like, such program codes are included in an embodiment of the present invention.

Furthermore, after the program codes supplied are stored in an expansion board of the computer, or in a memory provided in an expansion unit connected with the computer, a CPU provided in the expansion board or in the expansion unit may perform a part or all of processing to achieve the functions of the above-mentioned embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-336031, filed Dec. 13, 2006, which is hereby incorporated by reference herein in its entirety.

What is claimed is:

1. An ink jet printing apparatus for performing printing on a printing medium based on ejection data by using a printing head having a plurality of ejection opening arrays, each ejection opening array having a plurality of ejection openings which eject the same color ink and which are arranged along a first direction, the ejection opening arrays being arranged along a second direction intersecting with the first direction, wherein:

a ratio of ejection data distributed to at least one specific ejection opening array among the plurality of ejection opening arrays is higher than that of ejection data distributed to ejection opening arrays other than the at least one specific ejection opening array.

2. The ink jet printing apparatus according to claim 1, wherein the at least one specific ejection opening array includes an ejection opening array positioned centrally and the ejection opening arrays other than the at least one specific ejection opening array include ejection opening arrays positioned at both ends in the second direction.

3. The ink jet printing apparatus according to claim 1, wherein the at least one specific ejection opening array includes an ejection opening array positioned at one end side in the second direction and the ejection opening arrays other than the at least one specific ejection opening array include ejection opening arrays positioned at the other end side in the second direction.

4. The ink jet printing apparatus according to claim 1, comprising:

a conveying device for conveying the printing medium in the second direction, wherein printing is performed by ejecting ink from the printing head while the printing medium is being fed by said conveying device.

5. The ink jet printing apparatus according to claim 1, comprising:

a scanning device for scanning the printing head in the second direction; and a conveying device for conveying the printing medium in a direction intersecting with the second direction, wherein printing is performed by ejecting ink from the printing head while the printing head is being scanned by said scanning device.

6. An ink jet printing apparatus for performing printing on a printing medium based on ejection data by using a printing head having a plurality of ejection opening arrays, each ejection opening array having a plurality of ejection openings which eject the same color ink and which are arranged along a first direction, the ejection opening arrays being arranged along a second direction intersecting with the first direction, wherein:

the plurality of ejection opening arrays includes end ejection opening arrays positioned at both ends in the second direction and non-end ejection opening arrays other than the end ejection opening arrays, and a ratio of ejecting data distributed to each of the end ejection opening arrays is smaller than a ratio of ejecting data distributed to each of the non-end ejection opening arrays.

7. An ink jet printing method for performing printing on a printing medium based on ejection data by using a printing head having a plurality of ejection opening arrays, each ejection opening array having a plurality of ejection openings which eject the same color ink and which are arranged along a first direction, the ejection opening arrays being arranged along a second direction intersecting with the first direction, wherein:

a ratio of ejection data distributed to at least one specific ejection opening array among the plurality of ejection opening arrays is higher than that of ejection data distributed to the ejection opening arrays other than the at least one specific ejection opening array.

8. An ink jet printing method for performing printing on a printing medium based on ejection data by using a printing head having a plurality of ejection opening arrays, each ejection opening array having a plurality of ejection openings which ejects the same color ink and which are arranged along a first direction, the ejection opening arrays being arranged along a second direction intersecting with the first direction, wherein:

the plurality of ejection opening arrays includes end ejection opening arrays positioned at both ends in the second direction and non-end ejection opening arrays other than the end ejection opening arrays, and a ratio of ejecting data distributed to each of the end ejection opening arrays is smaller than the ratio of the ejecting data distributed to each of the non-end ejection opening arrays.

* * * * *